US006968836B1

(12) United States Patent
Kees

(10) Patent No.: US 6,968,836 B1
(45) Date of Patent: Nov. 29, 2005

(54) ARCHERY DRAWLOCK DEVICE WITH SIMULTANEOUS LOCK RELEASE AND FIRE

(76) Inventor: Galen D. Kees, 400 Second Ave. West, Durand, WI (US) 54736

( * ) Notice: Subject to any disclaimer, the term of this patent is extended or adjusted under 35 U.S.C. 154(b) by 0 days.

(21) Appl. No.: 10/944,366

(22) Filed: Sep. 16, 2004

(51) Int. Cl.[7] ..... F41B 5/00; F41B 5/18
(52) U.S. Cl. ..... 124/35.2; 124/86
(58) Field of Search ..... 124/23.1, 24.1, 124/25.6, 35.2, 86, 88

(56) References Cited

U.S. PATENT DOCUMENTS

| | | | | |
|---|---|---|---|---|
| 4,294,221 | A | 10/1981 | Bryant | |
| 4,403,436 | A | 9/1983 | Jennie | |
| 4,471,747 | A | 9/1984 | Nishioka | |
| 4,615,326 | A | 10/1986 | Rathburn | |
| 4,886,039 | A | 12/1989 | Wagner | |
| 4,919,107 | A * | 4/1990 | Bunts | 124/24.1 |
| 5,000,154 | A | 3/1991 | Slayton | |
| 5,002,035 | A | 3/1991 | Brooks | |
| 5,065,730 | A | 11/1991 | Kluver | |
| 5,092,309 | A | 3/1992 | Beaton | |
| 5,146,908 | A | 9/1992 | Larson | |
| 5,156,138 | A * | 10/1992 | Grover | 124/35.2 |
| 5,465,705 | A | 11/1995 | Baeseman | |
| 5,649,524 | A * | 7/1997 | Pullin | 124/86 |
| 5,671,723 | A | 9/1997 | Goff et al. | |
| 5,769,065 | A * | 6/1998 | Hurd | 124/24.1 |
| 5,944,004 | A | 8/1999 | Goff et al. | |
| 6,012,440 | A * | 1/2000 | Grindle | 124/86 |
| 6,513,511 | B1 * | 2/2003 | Garthe et al. | 124/25.6 |

* cited by examiner

*Primary Examiner*—John A. Ricci
(74) *Attorney, Agent, or Firm*—Anthony J. Bourget

(57) ABSTRACT

The present invention is directed to a drawlock device employed with a bow, such as a compound bow, that provides for drawing and locking the bowstring at the let-off point, then drawing the bowstring a short distance at which point the lock disengages the bowstring, simultaneously firing the arrow nocked on the bowstring.

23 Claims, 9 Drawing Sheets

ARCHERY DRAWLOCK DEVICE WITH SIMULTANEOUS LOCK RELEASE AND FIRE

BACKGROUND OF THE INVENTION

1. Field of the Invention

The present invention relates generally to archery and, more specifically, to a bow drawlock device and, most specifically, to a bow drawlock device with simultaneous lock release and fire.

2. Background Information

The sport of archery requires the archer to exert a relatively large force during bowstring pull back to draw the bow to a fully tensioned condition for firing an arrow. This is especially true of compound bows where the bowstring circumscribes eccentric wheels rotatably mounted on the ends of the bow's limbs and a large force must be applied by the archer's arms during the initial stages of string pull back. Consequently, even after firing just a few shots, muscles fatigue and cramping in the archer's arms and shoulders are often experienced, which leads to inaccuracy and prevents the archer from performing extensive target practice.

Archers and bow hunters have used drawlocks of various types for many years, including the locking mechanisms on centuries-old crossbows. For upright bows, including compound bows, a drawlock has generally been either a fixed rod along which the bowstring is drawn or a moveable rod drawn along with the bowstring. Both types use some sort of latch mechanism to lock the bowstring at full draw and a release mechanism to release the bowstring and propel the arrow. The term "full-draw" is used to mean the aimed draw position for a bow properly matched to the archer, rather than an absolute maximum draw.

Some examples of inventions concerned with bowstring drawlocks and releases for which patents have been granted are found in the following. Bryant, U.S. Pat. No. 4,294,221; Jennie, U.S. Pat. No. 4,403,436; Nishioka, U.S. Pat. No. 4,471,747; Rathbun, U.S. Pat. No. 4,615,326; Wagner, U.S. Pat. No. 4,886,039; Slayton, U.S. Pat. No. 5,000,154; Brooks, U.S. Pat. No. 5,002,035; Kluver, U.S. Pat. No. 5,065,730; Beaton, U.S. Pat. No. 5,092,309; Larson, U.S. Pat. No. 5,146,908; Baeseman, U.S. Pat. No. 5,465,705; Goff et al., U.S. Pat. No. 5,671,723; and Goff et al., U.S. Pat. No. 5,944,004.

None of these patents provide a drawlock system with simultaneous lock release and fire. Consequently, applicant has invented a drawlock device with simultaneous bowstring lock release and firing of an arrow. The drawlock device of the present invention functions in alignment with the arrow's path. In addition, the drawlock device is adjustable to fit different sized bows, and provides a secondary draw in which the lock releases simultaneously with the firing of the arrow.

SUMMARY OF THE INVENTION

The present invention is directed to a drawlock device with simultaneous bowstring lock release and firing of an arrow. The drawlock device includes a bar member having a slot in one exterior edge. A housing assembly, having a passageway therethrough, slidably accepts a first portion of the bar member therein, with a bar member's second portion extending exterior thereto. The housing assembly has an external slot generally parallel to the passageway and a cam member rotatably mounted interior the housing assembly's passageway. The cam member includes a cradle notch therein and a protruding shoulder portion. The cam member is rotatable from a bowstring accepting position with the cradle notch open to the housing assembly's external slot and the cam shoulder portion in the bar member slot, to a bowstring locked position with the cradle notch intersecting the housing assembly's external slot and the cam shoulder portion contacting the bar member's exterior edge adjacent the bar member slot. A stop limits movement of the housing assembly in a first direction toward the bar member's exterior second portion with the cam member in the bowstring locked position. Movement of the housing assembly along the bar member, in a direction opposite the first direction, allows the cam shoulder portion to enter the bar member slot, thereby rotating the cam member from a bowstring locked position to the bowstring accepting position, releasing the bowstring locked within the cradle notch.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
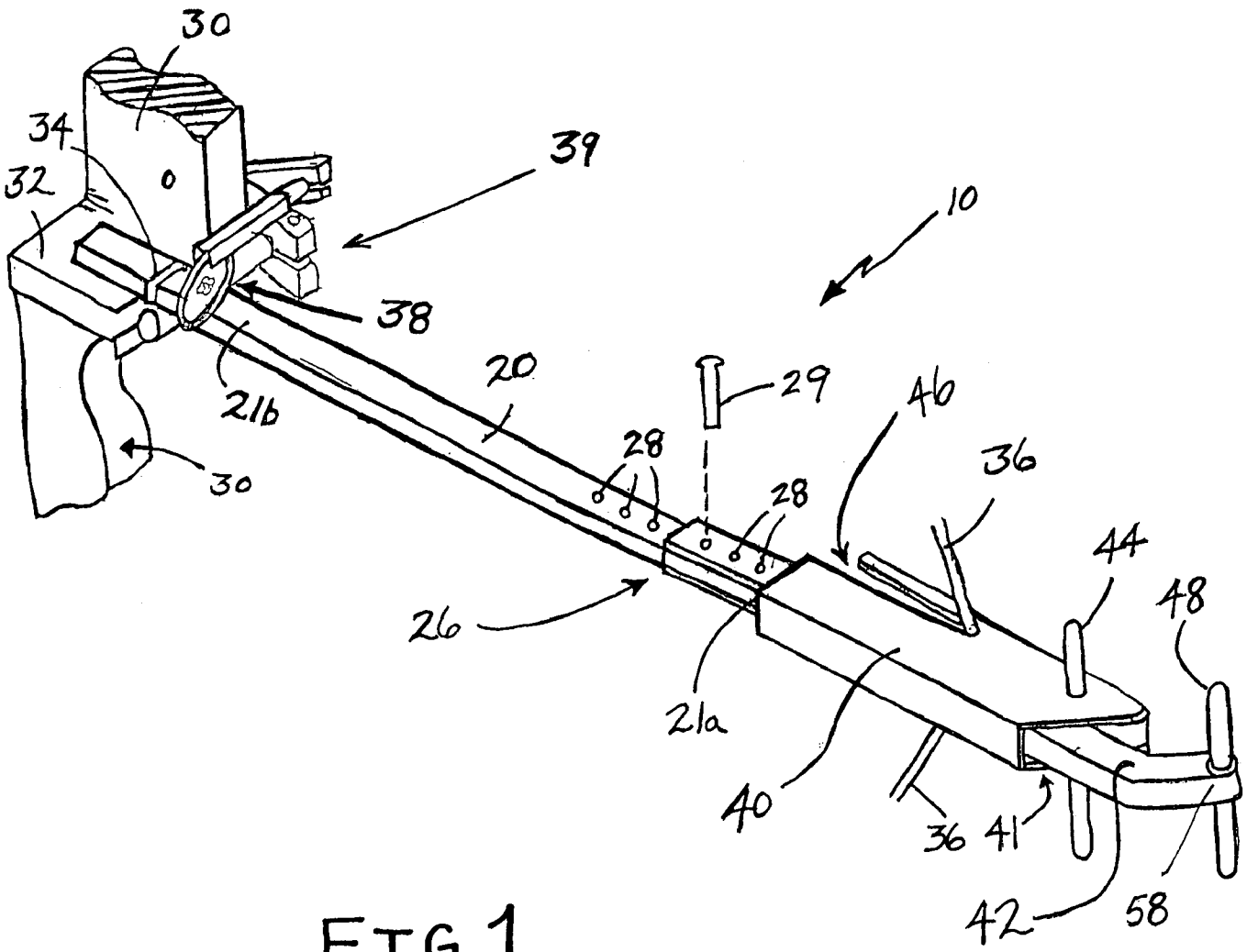
FIG. 1 is a perspective view of the drawlock device of one embodiment of the present invention engaging a bowstring at the let-off point.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DESCRIPTION OF THE EMBODIMENTS

The present invention is directed to a drawlock device employed with a bow, such as a compound bow, that provides for drawing and locking the bowstring at the let-off point, then drawing the bowstring a short distance at which point the lock disengages the bowstring, simultaneously firing the arrow nocked on the bowstring.

Figure 6:
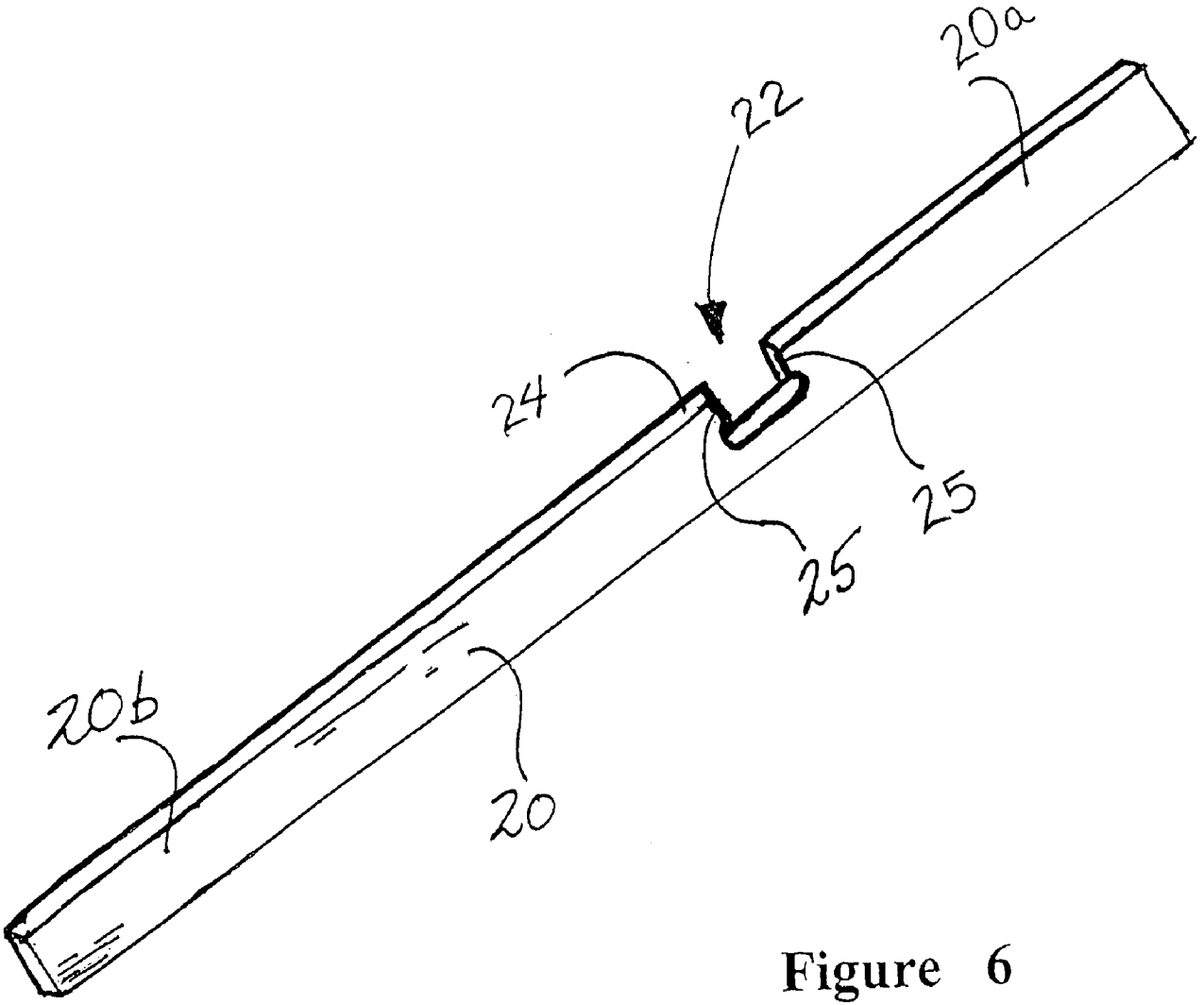
FIG. 6 is a perspective view of the bar member with a slot in one edge of the present invention.

Referring to FIG. 1, one embodiment of the drawlock device 10 of the present invention is shown attached to a bow. The drawlock device 10 includes a bar member 20 having a slot 22 in one external edge 24 thereof. Preferably, the bar member 20 is linear and rectangular, as illustrated in FIG. 6. Bar member 20 may be made of metal or other strong material, with a channel running its length. The bar member 20 is connected at one end to the bow handle 30 adjacent the bow shelf 32. The bar member 20 is held at the bow shelf 32 by a bar guide loop 34 attached thereto. Preferably, bar guide loop 34 is a staple-like or "U" shaped member. A whisker bisquit arrow rest 38 is positioned just above the bar member 20 by an attachment clamp 39 attached to the bow handle 30. The bar guide loop 34 is mounted to the bow handle 30 such that the bar member 20 is aligned with the arrow path. Preferably, bar member 20 is secured to handle 30 at a position in line with the arrow path to reduce torque commonly experienced with other types of drawlock devices which are commonly attached to a position off-set from the arrow path. The arrow (not shown) extends through the whisker biscuit arrow rest 38 near the arrow point end and connects with the bowstring 36 at the arrow's nocked end.

Figure 2:
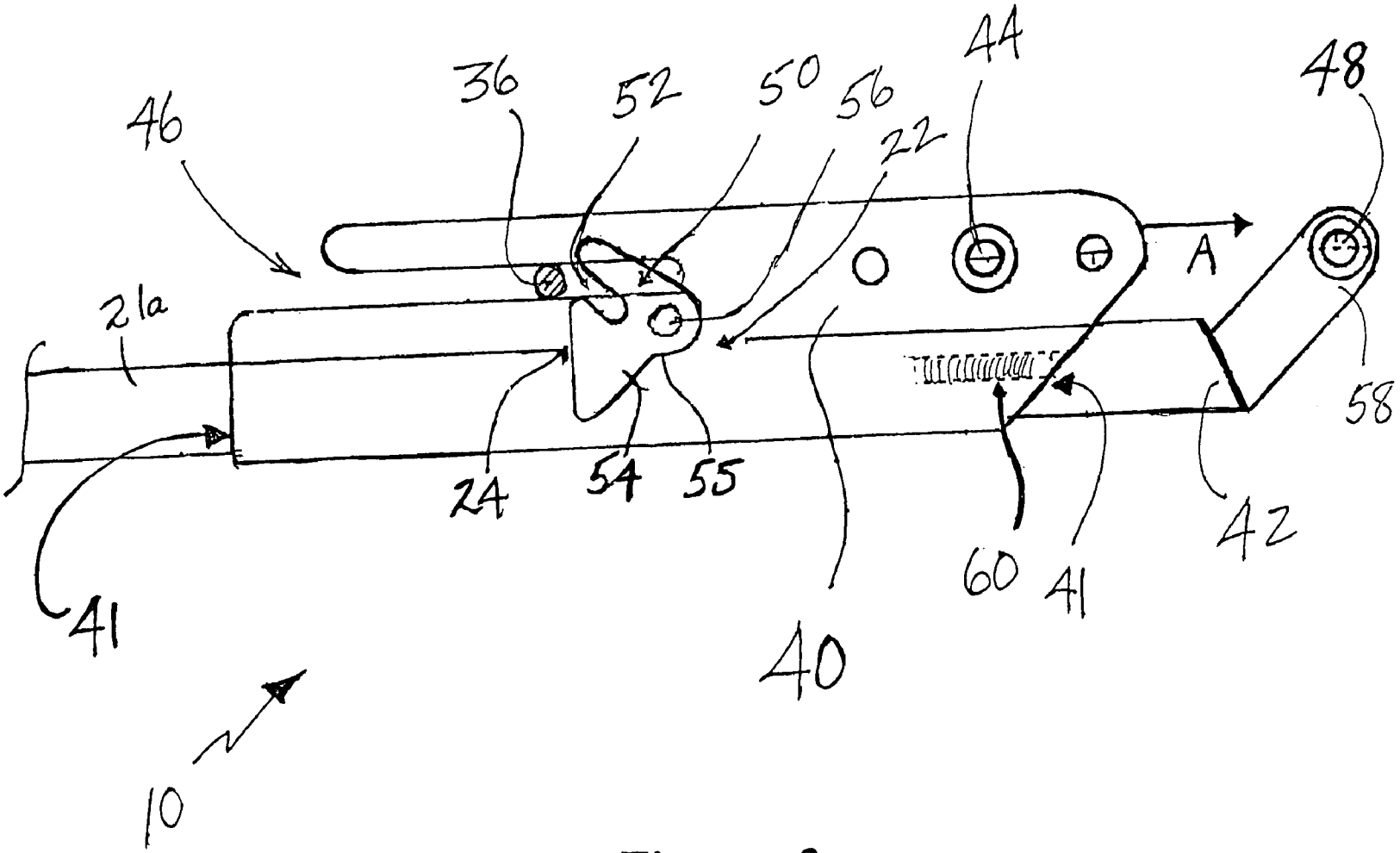
FIG. 2 is a top partial plan view of the drawlock device of embodiment of the present invention shortly before engaging a bowstring.
Figure 3:
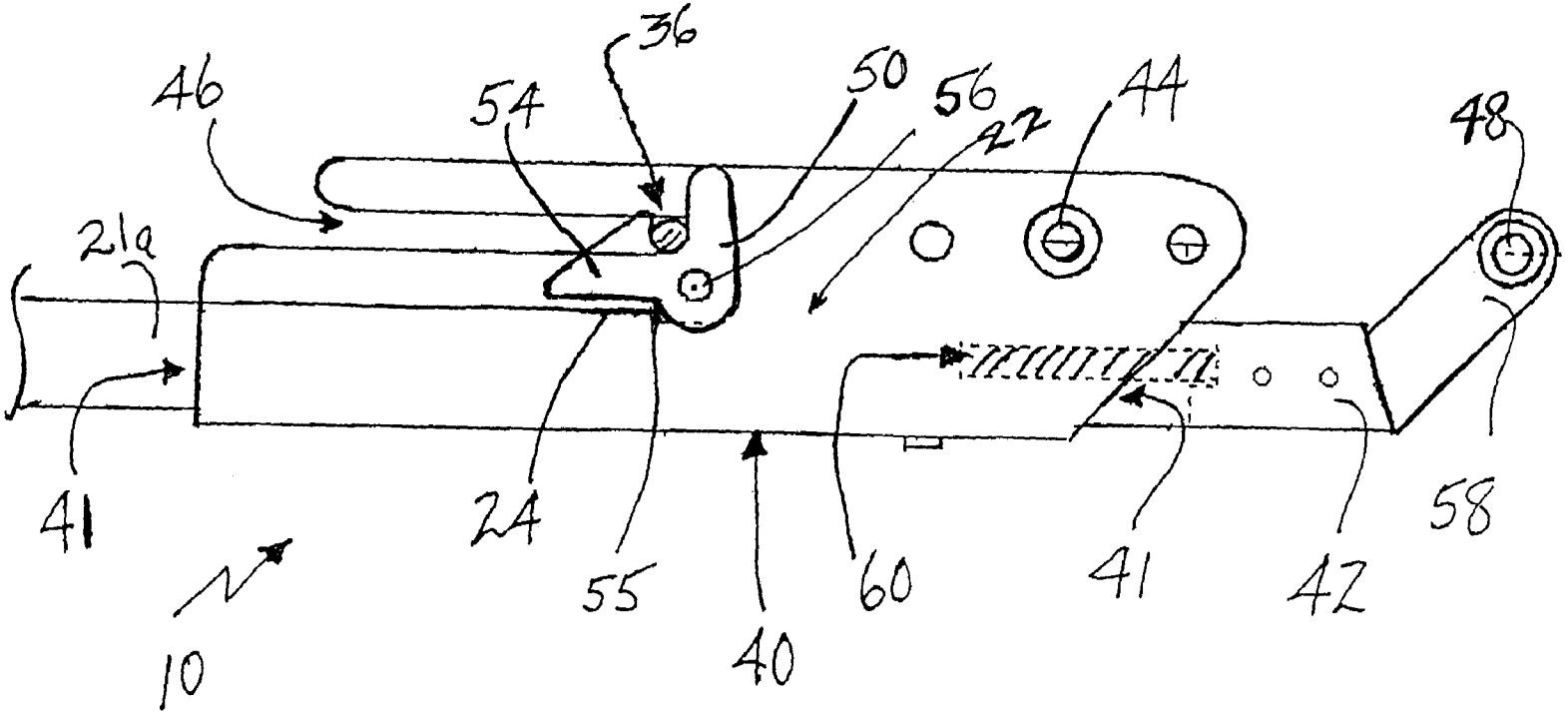
FIG. 3 is a top partial plan view of the drawlock device of embodiment of the present invention engaging a bowstring.
Figure 5:
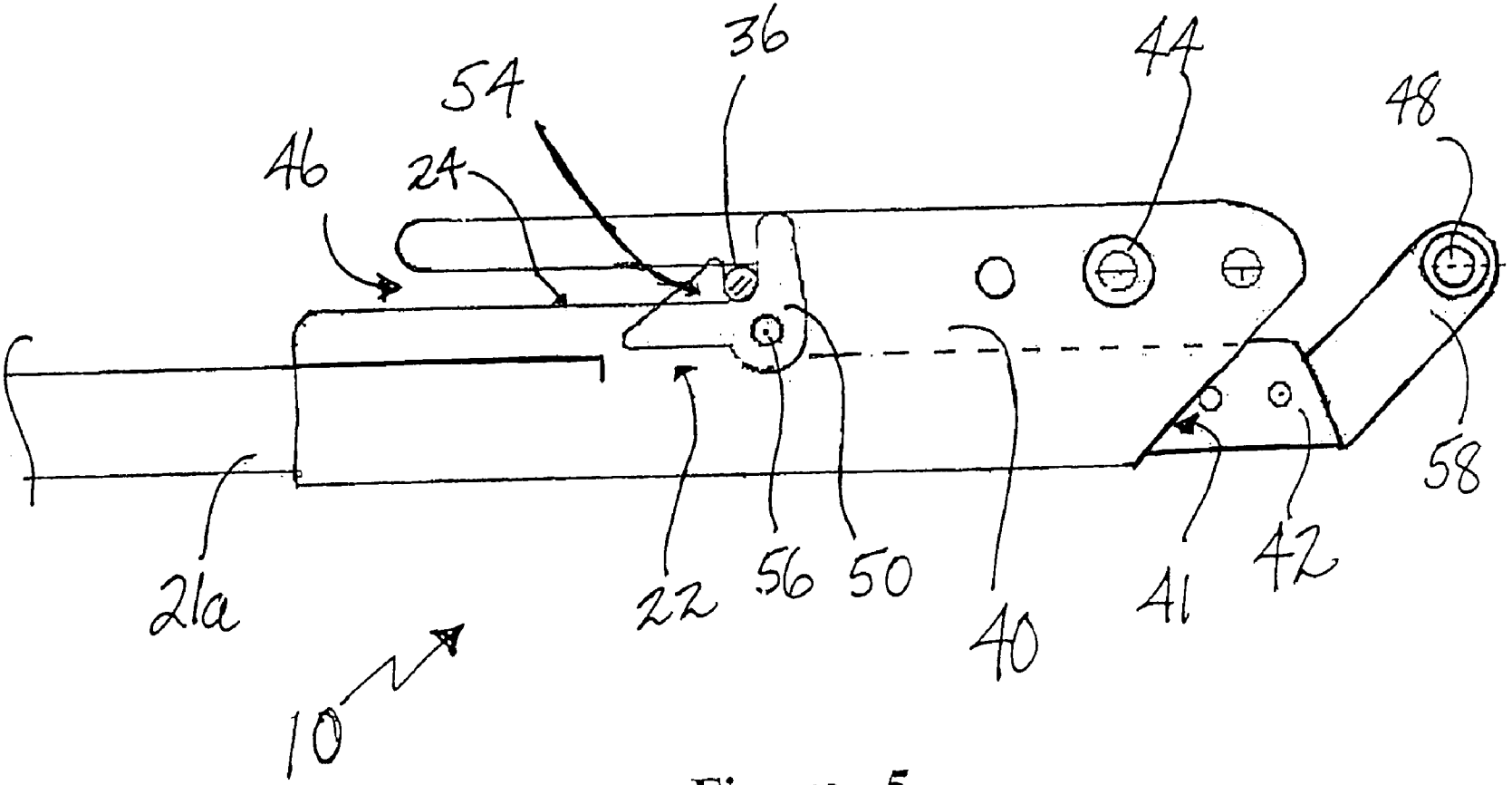
FIG. 5 is a top partial plan view of the drawlock device of embodiment of the present invention at both the lock release point and firing point of a bowstring.

At the bar member end opposite the bow handle 30 is a housing assembly 40. The housing assembly 40 has a passageway 41 therethrough for slidably accepting a first portion 20*a* of the bar member 20 therein, with a bar member's second portion 20*b* extending exterior thereto. The housing assembly 40 also has an external slot 46 oriented generally parallel to the passageway 41. Preferably, slot 46 is parallel to passageway 41. Preferably, the passageway 41 is linear, as is the external slot 46. A cam member 50 is rotatably mounted on a cam pin member 56, interior the housing assembly's passageway 41. The cam member 50 includes a cradle notch 52 therein and a protruding shoulder portion 54. The cam member 50 is rotatable from a bowstring accepting position, with the cradle notch 52 open to the housing assembly's external slot 46 and the cam shoulder portion 54 in the bar member slot 22 (FIG. 2), to a bowstring locked position with the cradle notch 52 intersecting the housing assembly's external slot 46 and the cam shoulder portion 54 contacting the bar member's external edge 24 adjacent the bar member slot 22 (FIG. 3). A stop limits movement of the housing assembly 40 in a first direction toward the bar member's exterior second section 20*b*. The stop comprises contact of an edge 55 of the cam member 50 adjacent the shoulder portion 54 thereof with an interior wall 25 of the bar member slot 22. Movement of the housing assembly 40 along the bar member 20, in a direction opposite the first direction, allows the cam shoulder portion 54 to enter the bar member slot 22, thereby rotating the cam member 50 from a bowstring locked position to the bowstring accepting position, thus releasing the bowstring 36 from within the cradle notch 52 (FIG. 5). In FIG. 2, housing assembly 40 is partially cut-away to reveal features of the invention including cam 50.

The drawlock device 10 further includes a draw handle member 42, biasedly positioned in the housing assembly's passageway 41 opposite the bar member 20, with the draw handle member 42 extending exterior the housing assembly 40. It may be appreciated that draw handle member 42 and bar member 20 may be preferably integrally connected. The draw handle member 42 exterior the housing assembly 40 is angled such that a peg member 48 traversing the exterior end 58 of handle member 42 is preferably vertically aligned with the bowstring 36 anchored within the housing assembly's external slot 46. The housing assembly 40 also includes a secondary handle peg member 44, preferably vertically aligned with the draw handle peg member 48 and the bowstring 30 anchored within the housing assembly external slot 46. The alignment of these three elements is apparent in FIGS. 2–5.

Figure 4:
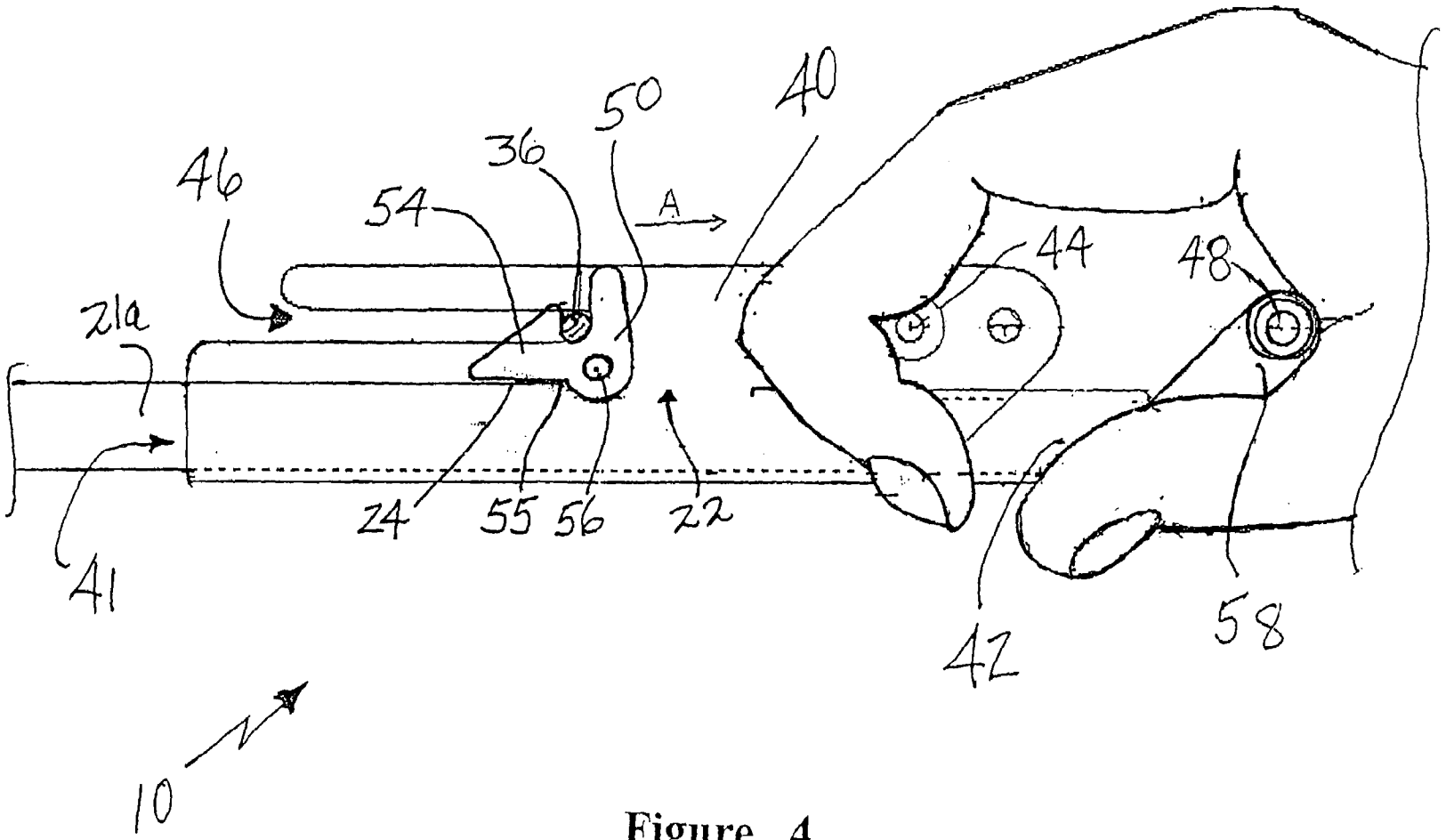
FIG. 4 is a top partial plan view of the drawlock device of embodiment of the present invention as the archer begins the secondary draw.

The draw handle member 42 also includes an optional biasing spring member 60 located interior the housing assembly 40, allowing the housing assembly 40 to move toward the exterior end 58 of the draw handle member 42 when force is applied between them, for example, by grasping both the draw handle peg member 48 and the secondary handle peg member 44 on the housing assembly 40, as illustrated in FIG. 4. As shown in FIG. 2 and FIG. 3, biasing spring member 60 is of a compression variety and is positioned behind cam member 50 away from bow handle 30. Alternatively, and while not shown in the drawings, spring member 60 may be of a tension variety and positioned in front of cam member 50 toward the bow handle 30. Spring member 60 urges housing assembly 40 to slide so that cam 50 may return to a string receiving position. With the bowstring 36 (and attached arrow) locked in the cradle notch 52 (FIG. 3), movement of the housing assembly 40 along the bar member 20 allows the cam shoulder portion 54 to enter the bar member slot 22, thereby rotating the cam member 50 to the bowstring accepting position, thus releasing the bowstring 36 from within the cradle notch 52 and firing the arrow (not shown).

Referring again to FIG. 1, a further aspect of the drawlock device 10 invention is illustrated. In this aspect, the bar member 20 is adjustable in length to position the bar member slot 22 therein at selected distances from the bar member end opposite the housing assembly 40. For example, the bar member 20 may include a telescoping section 26 that has a plurality of alignable apertures 28 designed to accept a fastener 29 to vary the length of the bar member 20. Thus, the drawlock device 10 is adjustable to fit a variety of bows of varying size.

Figure 7:
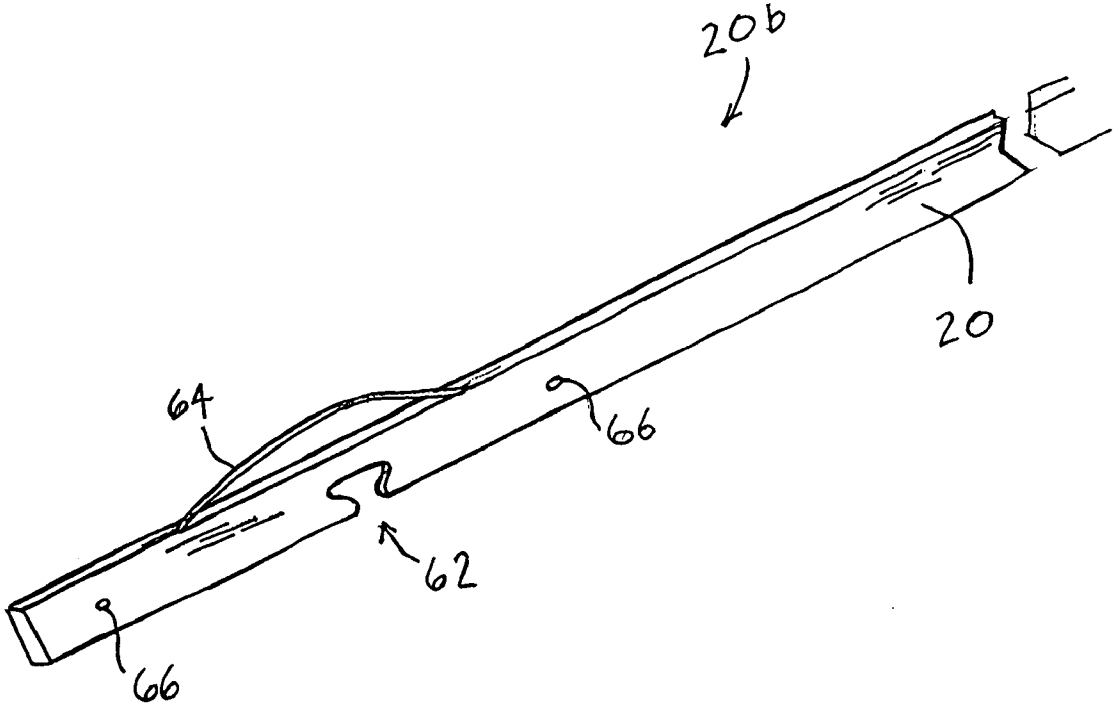
FIG. 7 is a partial perspective view of a portion of the bar member having a guide loop slot.

Referring to FIG. 7, a further aspect of the invention is shown. In this aspect, the bar member 20 includes a guide loop slot 62. Guide loop slot 62 receives bar guide loop 34, or at least a portion of the loop such as a prong of the staple-like structure, for secure positioning of the bar member 20 within the bar guide loop 34 on the bow handle 30. Biasing wire 64 may also be secured to bar member 20 for contact with a second prong of the staple-like guide loop 34. Biasing wire 64 is secured with at least one biasing pin 66, and is configured to spring outward from bar member 20 to contact with the second prong. Guide loop slot 62 allows a user to easily secure or detach bar member 20 to bow handle 30. Bar member 20 slides within guide loop 34 during a bow drawing motion and sets into position when guide loop slot 62 receives one of the prongs of loop 34. In the set position, movement of bar member 20 within guide loop 34 is inhibited, thus allowing bowstring 36 to be locked in a tension position toward the first portion of bar member 21*a*.

The sequence of use for the drawlock device 10 is now illustrated using FIGS. 2–5. Referring to FIG. 2, the housing assembly 40 receives the bowstring 36 within the external slot 46. The bowstring 36 enters the cradle notch 52 of the cam member 50. The user urges the bowstring 36 into the cradle notch 52, for example, by pushing the draw handle member 42 toward the bowstring 36. The cam member 50 is pivotably connected to the housing assembly 40 at the cam pivot pin member 56. As the user urges the bowstring 36 into the cradle notch 52, the housing assembly 40 slides in the direction of arrow A, as shown in FIG. 2. As the housing assembly 40 slides along the bar member 20 in the direction of arrow A, the cam member 50 rotates in a clockwise direction until the bowstring 36 is positioned within the cradle notch 52. The housing assembly 40 moves along the bar member 20 a sufficient distance so that the cam shoulder portion 54 clears the interior wall 25 of the bar member slot 22. At this point, the housing assembly 40 slides in the direction opposite arrow A, such that the cam shoulder portion 54 rests on the exterior edge 24 of the bar member 20 adjacent the bar member slot 22, as illustrated in FIG. 3. Housing assembly 40 is urged in the direction opposite arrow A by optional spring 60. The cam cradle notch 52 now intersects the housing assembly's external slot 46. The housing assembly 40 is prevented from moving further toward the bow handle 30, caused by the tension of the bowstring 36, by a stop within the housing assembly 40. The stop comprises contact of an edge 55 of the cam member 50, adjacent the cam protruding shoulder 54, with the interior wall 25 of the bar member slot 22, as illustrated in FIGS. 3 and 4. The bowstring 36 is now locked in position and is not released from the cam cradle notch 52 until the cam shoulder portion 54 clears the bar member's exterior edge 24 adjacent the bar member slot 22, and the cam member 50 rotates counter-clockwise. The user assures that the bar member 20 is positioned within the bar guide loop 34 on the bow handle 30. The bowstring 36 is then drawn into tension position (while bar member 20 simultaneously slides within bar guide loop 34 until set with guide loop slot 62 engaging with bar guide loop 34) and an arrow (not shown) is notched on the bowstring 36. A user pulls back on draw handle member 42 (usually by grasping peg member 48) to draw back on bowstring 36, or alternatively may manually grasp bowstring 36 for such draw. The tension of the bowstring 36 in the drawn position maintains the cam member 50 in a blocked or locked position, with the cam shoulder portion 54 resting on the exterior edge 24 of the bar member 20 and the edge 55 of the cam member 50 contacting the internal wall 25 of the bar member slot 22, as illustrated in FIGS. 3 and 4.

Referring now to FIG. 4, the user grasps the draw handle member 42 with the palm and the secondary handle peg member 44 with the first two fingers, as illustrated. The user then accomplishes a secondary draw of the bowstring 36 and notched arrow, which includes squeezing the fingers of the hand. The squeezing action draws the secondary handle peg member 44 and attached housing assembly 40 toward the exterior end 58 of the draw handle member 42 and along the bar member 20. As the cam shoulder portion 52 slides along the exterior edge 24 of the bar member 20, the cam shoulder portion 52 clears the exterior edge 24, as shown in FIG. 5. The tension of the bowstring 36 immediately rotates the cam member 50 counter-clockwise, and the cam shoulder portion 52 enters the slot 22 in the bar member 20, thereby releasing the bowstring 36 and firing the arrow from the bow. Alternatively, the user accomplishes a secondary draw of the bowstring 36 and notched arrow by pulling back on secondary handle peg member 44 in the direction of arrow A (i.e., without squeezing). The foregoing allow the user to independently support the entirety of the tension of the bowstring for the secondary draw/release. For the secondary draw, the string 36 is actually drawn back further from the first drawn position.

The movement of the housing assembly 40 along the bar member 20 from the bowstring's locked position to the unlocked or release position is termed the secondary draw. The secondary draw is a requirement for bow hunting in some states. Preferably, the secondary draw is about three-fourths of an inch, a distance easily achieved by a user grasping the draw handle member 42 and the secondary handle peg member 44 with one hand and squeezing, or alternatively by drawing back on the secondary handle peg member 44. The biasing spring member 60 of the draw handle member 42 provides for smooth movement between the housing assembly 40 and the draw handle member 42, allowing for a controlled release of the drawlock device 10 and simultaneous firing of an arrow. The biasing spring member 60 may further operate to return housing assembly 40 and cam member 50 to a bowstring accepting position.

Figure 8:
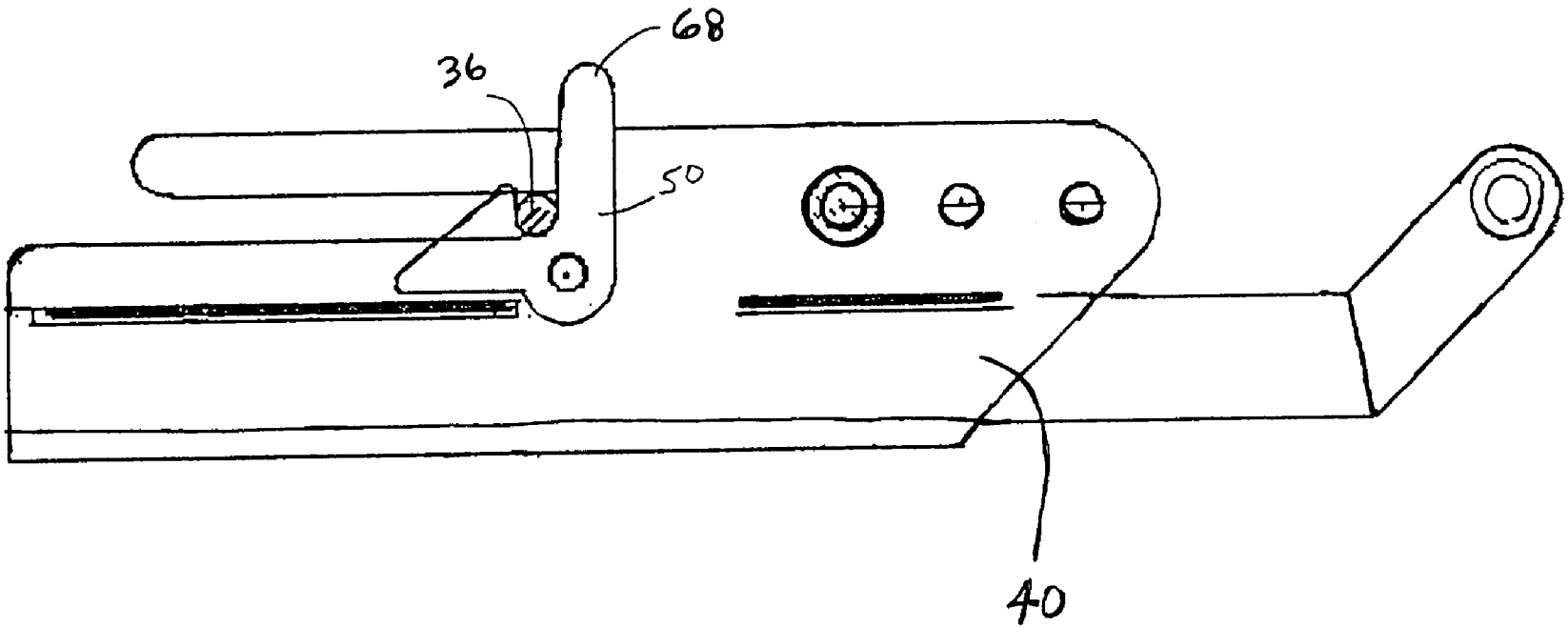
FIG. 8 is a top partial plan view of the drawlock device of embodiment of the present invention.
Figure 9:
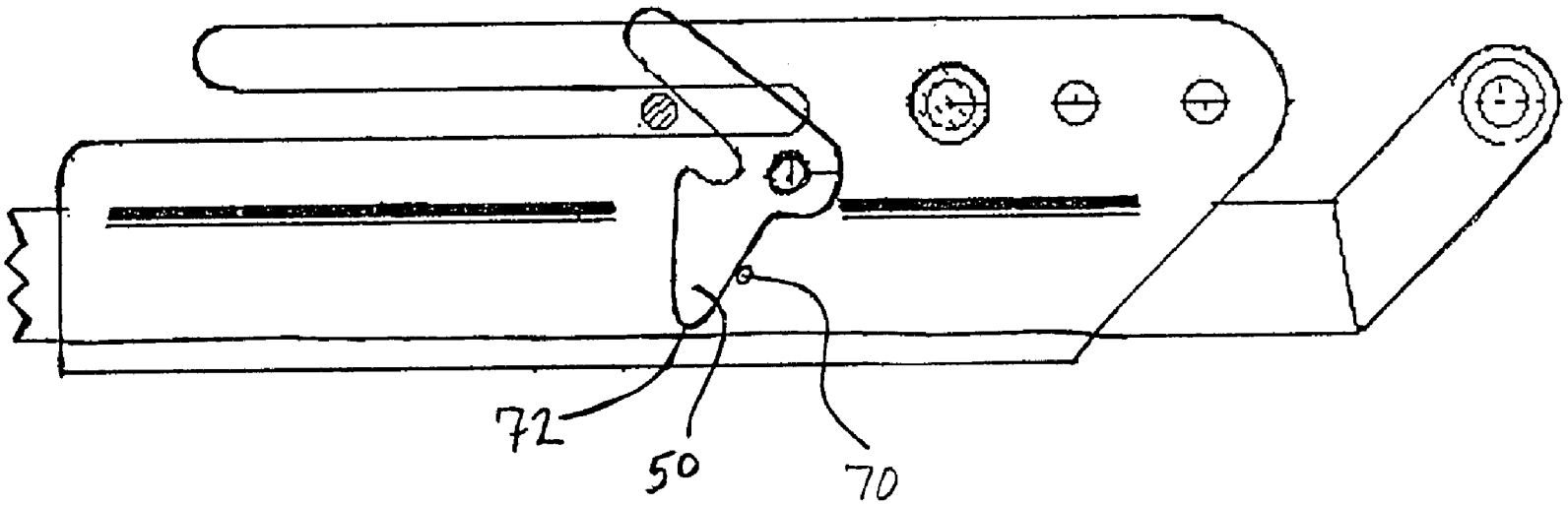
FIG. 9 is a top partial plan view of the drawlock device of FIG. 8 in a bowstring release/accept position.

On occasion cam member 50 may rotate upon firing to such an extent that it becomes difficult for a user to place the cam 50 in the string accepting position for the next firing. Preferably, as shown in FIG. 8, cam 50 includes tab 68 which extends from housing assembly 40 so that a user may manually rotate and align cam member 50 into a bowstring accepting position. Further, a pin 70 can be positioned within passageway 41 and slot 22 (See FIG. 9) to assure that cam 50 does not over-rotate, thus making it easier for a user to re-align cam 50 into a bowstring accepting position. In some situations bar member 20 and/or housing 40 may be configured such that cam tip 72 does not abut against bar member 20. In those situations it is preferred to have pin 70 is positioned so cam 50 abuts pin 70 to avoid over-rotation.

While the present invention has been described with reference to several particular example embodiments, those skilled in the art will recognize that many changes may be made thereto without departing from the spirit and scope of the present invention, which is set forth in the following claims.

We claim:

1. A drawlock device with concurrent lock release and fire of a bowstring comprising;

(a) a bar member having a slot in one exterior edge;

(b) a housing assembly having a passageway therethrough slidably accepting a first portion of the bar member therein, with a bar member's second portion extending exterior thereto, the housing assembly having an external slot generally parallel to the passageway;

(c) a cam member rotatably mounted interior the housing assembly's passageway, the cam member including a cradle notch therein and a protruding shoulder portion, the cam member rotatable from a bowstring accepting position with the cradle notch open to the housing assembly's external slot and the cam shoulder portion in the bar member slot, to a bowstring locked position with the cradle notch intersecting the housing assembly's external slot and the cam shoulder portion contacting the bar member's exterior edge adjacent the bar member slot; and (d) a stop, limiting movement of the housing assembly in a first direction toward the bar member's exterior second portion with the cam member in the bowstring locked position; whereby movement of the housing assembly along the bar member, in a direction opposite the first direction, allows the cam shoulder portion to enter the bar member slot, thereby rotating the cam member from a bowstring locked position to the bowstring accepting position, releasing the bowstring locked within the cradle notch.

2. The drawlock device according to claim 1, wherein the stop comprises an interior wall of the bar member slot.

3. The drawlock device according to claim 1, wherein the stop comprises contact of an edge of the cam member adjacent the shoulder portion thereof with an interior wall of the bar member slot.

4. The drawlock device according to claim 1, further including a draw handle member biasedly positioned in the housing assembly's passageway opposite the bar member, the draw handle member extending exterior the housing assembly.

5. The drawlock device according to claim 4, wherein the draw handle member includes a linear peg member exterior the housing assembly, the peg member vertically aligned with a bowstring in the housing assembly's external slot.

6. The drawlock device according to claim 1, wherein the housing assembly includes a secondary handle member comprising a linear peg member vertically aligned with a bowstring in the housing assembly's external slot.

7. The drawlock device according to claim 1, wherein the second portion of the bar member exterior the housing assembly is adapted for attachment, at an end opposite the housing assembly, adjacent a bow shelf of a bow handle.

8. The drawlock device according to claim 7, wherein the bar member adapted for attachment adjacent a bow shelf of a bow handle provides alignment of the housing assembly's external slot with an arrow positioned for firing by the bow.

9. The drawlock device according to claim 7, further including a bar member guide loop secured adjacent a bow shelf to accept the end of the bar member opposite the housing assembly.

10. The drawlock device according to claim 7, wherein the bar member includes a guide loop slot.

11. The drawlock device according to claim 1, wherein the bar member is adjustable in length to position the slot therein at selected distances from a bar end opposite the housing assembly.

12. A drawlock device with concurrent lock release and fire of a bowstring comprising;

(a) a linear bar member having a slot in one exterior edge;

(b) a housing assembly having a linear passageway therethrough slidably accepting a first portion of the bar member therein, with a bar member's second portion extending exterior thereto, the housing assembly having an external slot generally parallel to the passageway;

(c) a cam member rotatably mounted interior the housing assembly passageway, the cam member including a cradle notch therein and a protruding shoulder portion, the cam member rotatable from a bowstring accepting position with the cradle notch open to the housing assembly's external slot and the cam shoulder portion in the bar member slot, to a bowstring locked position with the cradle notch intersecting the housing assembly's external slot and the cam shoulder portion contacting the bar member's exterior edge adjacent the bar member slot; and (d) a stop, limiting movement of the housing assembly in a first direction toward the bar member's exterior second portion with the cam member in the bowstring locked position, the stop comprising contact of an edge of the cam member adjacent the shoulder portion thereof with an interior wall of the bar member slot; whereby movement of the housing assembly along the bar member, in a direction opposite the first direction, allows the cam shoulder portion to enter the bar member slot, thereby rotating the cam member from the bowstring locked position to the bowstring accepting position, releasing the bowstring locked within the cradle notch.

13. The drawlock device according to claim 12, further including a draw handle member biasedly positioned in the housing assembly's linear passageway opposite the linear bar member, the draw handle member extending exterior the housing assembly.

14. The drawlock device according to claim 13, wherein the draw handle member includes a linear peg member exterior the housing assembly, the peg member vertically aligned with a bowstring in the housing assembly's external slot.

15. The drawlock device according to claim 12, wherein the housing assembly includes a secondary handle member comprising a linear peg member vertically aligned with a bowstring in the housing assembly's external slot.

16. The drawlock device according to claim 12, wherein the second portion of the bar member exterior the housing assembly is adapted for attachment, at an end opposite the housing assembly, adjacent a bow shelf of a bow handle.

17. A drawlock device according to claim 16, wherein the bar member adapted for attachment adjacent a bow shelf of a bow handle provides alignment of the housing assembly's external slot with an arrow positioned for firing by the bow.

18. The drawlock device according to claim 16, further including a bar member guide loop secured adjacent a bow shelf to accept the end of the bar member opposite the housing assembly.

19. The drawlock device according to claim 12, wherein the bar member is adjustable in length to position the slot therein at selected distances from a bar end opposite the housing assembly.

20. The drawlock device with concurrent lock release and fire of a bowstring comprising;

(a) a bar member having a slot in one exterior edge;

(b) a housing assembly having a passageway therethrough slidably accepting a first portion of the bar member therein, with a bar member's second portion extending exterior thereto, the housing assembly having an external slot generally parallel to the passageway, the housing assembly including a secondary handle member comprising a linear peg member vertically aligned with a bowstring in the housing assembly's external slot;

(c) a draw handle member biasedly positioned in the housing assembly's passageway opposite the bar member, the draw handle member extending exterior the housing assembly and including a linear peg member exterior the housing assembly, the peg member vertically aligned with a bowstring in the housing assembly's external slot;

(d) a cam member rotatably mounted interior the housing assembly passageway, the cam member including a cradle notch therein and a protruding shoulder portion, the cam member rotatable from a bowstring accepting position with the cradle notch open to the housing assembly's external slot and the cam shoulder portion in the bar member slot, to a bowstring locked position with the cradle notch intersecting the housing assembly's external slot and the cam shoulder portion contacting the bar member's exterior edge adjacent the bar member slot; and (e) a stop, limiting movement of the housing assembly in a first direction toward the bar member's exterior second portion with the cam member in the bowstring locked position, the stop comprising contact of an edge of the cam member adjacent the shoulder portion thereof with an interior wall of the bar member slot;

whereby movement of the housing assembly along the bar member, in a direction opposite the first direction, allows the cam shoulder portion to enter the bar member slot, thereby rotating the cam member from a bowstring locked position to the bowstring accepting position, releasing the bowstring locked within the cradle notch.

21. The drawlock device according to claim 20, wherein the second portion of the bar member exterior the housing assembly is adapted for attachment, at an end opposite the housing assembly, adjacent a bow shelf of a bow handle.

22. The drawlock device according to claim 20, further including a bar member guide loop secured adjacent a bow shelf to accept the end of the bar member opposite the housing assembly.

23. The drawlock device according to claim 20, wherein the bar member is adjustable in length to position the slot therein at selected distances from a bar end opposite the housing assembly.

* * * * *